US006266989B1

(12) United States Patent
Pohl et al.

(10) Patent No.: US 6,266,989 B1
(45) Date of Patent: Jul. 31, 2001

(54) METHOD AND MACHINE FOR STRAIGHTENING SECTIONS

(75) Inventors: Siegfried Pohl, Duisburg; Manfred Riffelmann, Moers, both of (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/537,458

(22) Filed: Mar. 27, 2000

(30) Foreign Application Priority Data

Mar. 26, 1999 (DE) ..... 199 15 145
Mar. 13, 2000 (DE) ..... 100 13 229

(51) Int. Cl.[7] ..... B21B 31/07
(52) U.S. Cl. ..... 72/245; 72/10.1; 72/10.4; 72/14.4; 72/164; 72/366.2
(58) Field of Search ..... 72/245, 10.1, 10.4, 72/10.6, 13.4, 14.4, 14.5, 14.7, 247, 160, 164, 366.2

(56) References Cited

U.S. PATENT DOCUMENTS 4,111,025 * 9/1978 Nakajima et al. ..... 72/164
4,222,256 * 9/1980 Johnson ..... 72/164
4,313,322 * 2/1982 Malinowski et al. ..... 72/164
4,759,485 * 7/1988 Braun et al. ..... 72/245

* cited by examiner

*Primary Examiner*—Ed Tolan
(74) *Attorney, Agent, or Firm*—Cohen, Pontani, Lieberman & Pavane

(57) ABSTRACT

A method and a machine for straightening sections by eliminating multi-axle deviations from the required section and from the required straightness using one or more straightening tools arranged, in series above and below the material to be straightened, on straightening axles which are parallel with one another. The adjustment of the straightening force and the adjustment of the horizontal inclination of the adjustable straightening axle are carried out hydraulically. The hydraulic system is configured so that a rapid change in position is possible either at the front and rear hydraulic cylinders or exclusively at the rear hydraulic cylinder in such a way that the straightening force and/or the horizontal inclination of the adjustable straightening axle can also be set during the straightening process.

9 Claims, 2 Drawing Sheets

METHOD AND MACHINE FOR STRAIGHTENING SECTIONS

BACKGROUND OF THE INVENTION

1. Field of the Invention

The invention relates to a method and a machine for straightening sections using one or more straightening tools which are arranged in series above and below the material to be straightened on straightening axles which are parallel with one another, in order to eliminate multi-axle deviations from the required section.

2. Discussion of the Prior Art

After rolling, sections are fed to a cooling bed. Here they generally remain at a temperature of up to approximately 60° C. for cooling purposes. As a result of the rolling process, but in particular also as a result of the cooling, the sections become distorted in a particularly asymmetrical way, both vertically and horizontally, and may additionally twist about the longitudinal axis. In addition to the geometric irregularity of the rolled material, the consequences are inherent stresses in the material which become more apparent when the section is divided.

In order to straighten elongated, cylindrical workpieces, a machine is known in which at least three straightening elements engage around the workpiece in one plane (German reference DE 196 51 422 A1). It is not possible to use this arrangement of the straightening elements in one plane to straighten sections.

Furthermore, German reference DE-AS 1264936 discloses a device for bending thin-walled sections back into the desired shape, different shaping rollers being used depending on the type of section. For sections which are bent in a U-shape, a shaping tool is known which has a disk-like tool which extends into the section. In order to be able to operate on both sides in the relatively narrow gap, the drive unit which holds the tool is mounted in a tiltable fashion. It is not possible to use this device to straighten thick-walled sections which have been produced by rolling.

Hitherto, straightening machines, in particular those which were used for relatively thick-walled sections, have been used to generate a dual-axle plane position by subjecting the section to alternating bending on certain surfaces using straightening rollers which are arranged above and below the material to be straightened and which are mounted on straightening axles or straightening disks which are each arranged in the same plane and have a preset pitch and/or a specific spacing. The alternating bending then leads ideally to an improvement in the straightness in the vertical, and possibly also, the horizontal direction.

Due to the fact that the known straightening axles are mounted at one end, the straightening axles sag during the straightening process. This causes the straightening gap between the straightening rollers to become wider in an undesired way which cannot be compensated for, said straightening rollers being attached to a shaft which ultimately results in adverse effects on the straightening result from nonuniform alternating bending, and thus nonuniform distributions of stress as well as nonuniform plastic deformations. It is to be borne in mind here that the entire amount of roll spring is made up here of deformation of the bearings, the installed elements, the upright and, in the case of electromechanical adjustment, from which the spindles and worm wheels themselves are made up. Because very different straightening forces are necessary for different sections, they will always result in different amounts of roll spring.

Because, in the case of electromechanical adjustment of the straightening axles, for example using a spindle, the straightening gap is preset without material, it is also not possible to correct the straightening gap sufficiently quickly under a straightening force. Therefore, due to the system it is not possible to compensate relatively large loads as a result of, for example, relatively large nonuniformities.

It is also impossible to use electromechanical adjustment for rapid advancing, i.e. feeding in the section with an open adjustment and subsequent closing.

In addition, it is also possible for the straightening shafts to be overloaded, resulting in a fracture, if an excessively high adjustment value has been selected.

By constructing the straightening rollers from disks it is possible to influence the section in a selective fashion, enabling the dimensions to be set accurately. Because the nonuniformities may be manifest in different ways over the length of the section, additional variable forces are produced, which, as illustrated above, also affect the sagging of the straightening axles.

SUMMARY OF THE INVENTION

The object of the present invention is to provide a method and a machine for straightening sections with little inherent stress, with which an improved straightening effect is achieved by taking into account sagging of the straightening axles resulting from variable straightening forces.

In order to achieve the object, a method is proposed in which both the adjustment of the straightening force and the adjustment of the horizontal inclination of the adjustable straightening axle are carried out hydraulically. The hydraulic system is configured so that a rapid change in position is possible either at the front and rear hydraulic cylinders or exclusively at the rear hydraulic cylinder so that the straightening force and/or the horizontal inclination of the adjustable straightening axle can also be set during the straightening process.

The straightening method according to the invention facilitates very rapid compensation of the bending of the straightening axles during the straightening process and thus permits the straightening gap to be corrected when there are changing straightening forces.

In addition, according to another feature of the invention, each straightening axle can be adjusted using the straightening tools without load in the axial direction independently of the other straightening axle. This adjustment takes place electromechanically, hydraulic clamping being performed so that a play-free axial position is obtained.

In this way, inaccuracies in the section can also be compensated in the transverse plane.

According to a further feature of the invention, there is provision for each adjustment device to have a measuring system whose signal is fed into a computer-based control model with which, taking into account the geometry of the straightening machine and the measurement results, the position of the straightening roller and the adjustment of the straightening roller are calculated with the bending of the straightening axle which occurs, and straightening-gap-optimizing specifications, with which the straightening axles are set, are determined.

The advantage of the method according to the invention consists in the fact that when the systems are adjusted, the straightening gap can also be adjusted under straightening force. In this way, fluctuations in the straightening force can be compensated dynamically by an uneven or nonuniform shape of the section. The hydraulic adjustment also permits overload protection to be implemented in a simple way because just one pressure limiting valve has to be integrated into the hydraulic system to do so. Optimizing the straightening gap not only increases the straightness but also removes twisting from the section and homogenizes the distribution of stress.

A machine for straightening sections is distinguished by the fact that the vertical setting and inclination of at least one, preferably the lower straightening roller unit, can be adjusted by means of vertically acting hydraulic cylinders which are couples to the two ends of the straightening axle.

It is advantageous if the hydraulic cylinder which faces the straightening unit is provided as a straightening force cylinder, predominantly for setting the straightening gap, and the hydraulic cylinder which faces away from the straightening unit is provided as an inclination cylinder. In this way, the sagging of the straightening axle can be compensated simply by changing the travel of the inclination cylinder. The result of this for the measurement system is that the influence of the inclination does not falsify the set value.

As a result of the fact that all the straightening axles can be displaced axially independently of one another by means of horizontal adjustment drives which are embodied as threaded spindles and/or hydraulic cylinders, the axial position of the upper and lower straightening axles can be defined without play.

According to the invention, displacement signal transmitters are provided on the straightening force cylinder, on the inclination cylinder and on the horizontal adjustment drive, and force measuring devices are provided on the straightening force cylinder. The measured values of the force measuring devices are capable of being fed, together with the measured values representing the measured current drain at the main drives, to a computer in which the adjustment values for the degrees of freedom of the machine can be calculated on the basis of a computational model. In this way, the controlled setting and adjustment of the axial inclination for compensating the bending around a parallel straightening gap can be generated so that the straightening method according to the invention and the machine can be used to define, free of play, both the axial positions of the upper and lower straightening axles independently of one another, like also the vertical position, also permitting a horizontal straightening capability and standardization capability. The setting and adjustment according to the invention of the axial inclination also generate a parallel straightening gap under rolling load.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
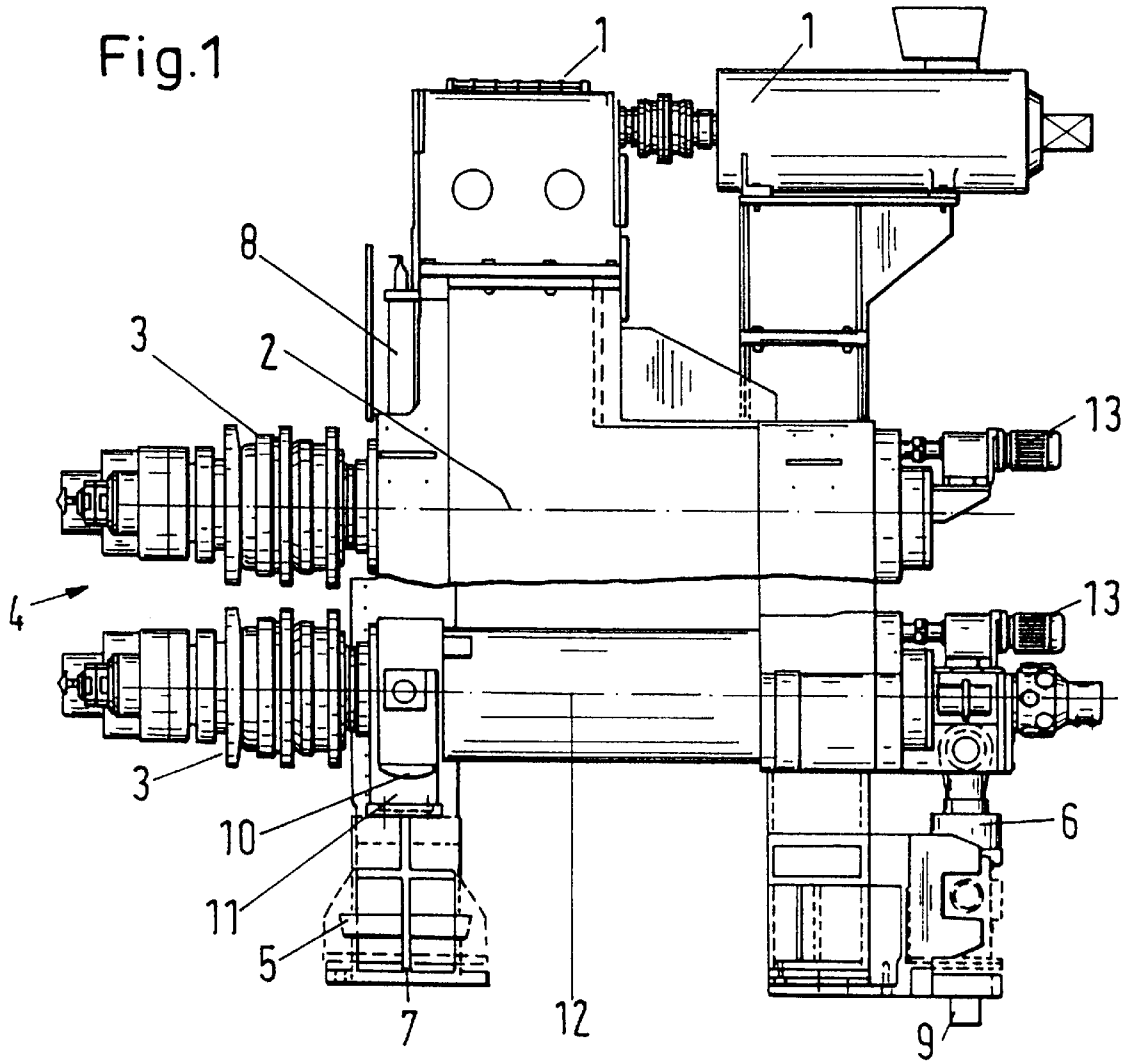
FIG. 1 shows a straightening device pursuant to the present invention with upper and lower straightening axles.

The inventive straightening machine essentially comprises an upper and a lower straightening roller unit 4 which are not illustrated in detail. The upper straightening roller unit contains in each case a drive including a gearbox 1 which is connected to the upper straightening axle 2 on which one or more straightening disks 3, for example having different diameters, are arranged above the section (not illustrated) on a sleeve, premounted with respect to the straightening roller unit 4.

Each lower straightening roller unit 4 is vertically adjustable. The straightening axle 12 is moved into position by means of a hydraulic cylinder 5, 6. While the straightening cylinder 5 which faces the straightening roller unit 4 predominantly sets the straightening gap, the bending of the straightening axle 12 which comes about under load is compensated by means of the inclination cylinder 6 located at the free end of the straightening axle 12. To do this, the lower straightening axle 12 is mounted in an articulated fashion above the straightening force cylinder 5 in a spherical cap 10.

The lower straightening axle 12 is guided in a carriage 11 which is attached to the base frame of the machine. The lower straightening axle 12 and upper straightening axle 2 are mounted in roller bearings and are adjusted axially be means of a geared motor 13. The position which is moved into is clamped free of play by means of a hydraulic clamping mechanism. In order to make selective settings, displacement measuring systems are provided at the end of the axles and are used for control of axle position. The requirements for precise positioning for horizontal adjustment of the set 4 of straightening rollers are also met here by the displacement measuring device. This degree of freedom benefits in particular the straightening and standardization of asymmetrical sections.

The computer model which is associated with the control and setting of the machine obtains section-related values for the set up from a database. The straightening force cylinder 5 has in addition a straightening force measurement system 7. The inclination cylinder 6 at the free end of the straightening axle 12 also has, like the end of the straightening axle, a displacement measurement system 9. All the displacement measurement systems have the function of making available their actual value for the controller, and are also used for making selective changes in position.

Figure 2:
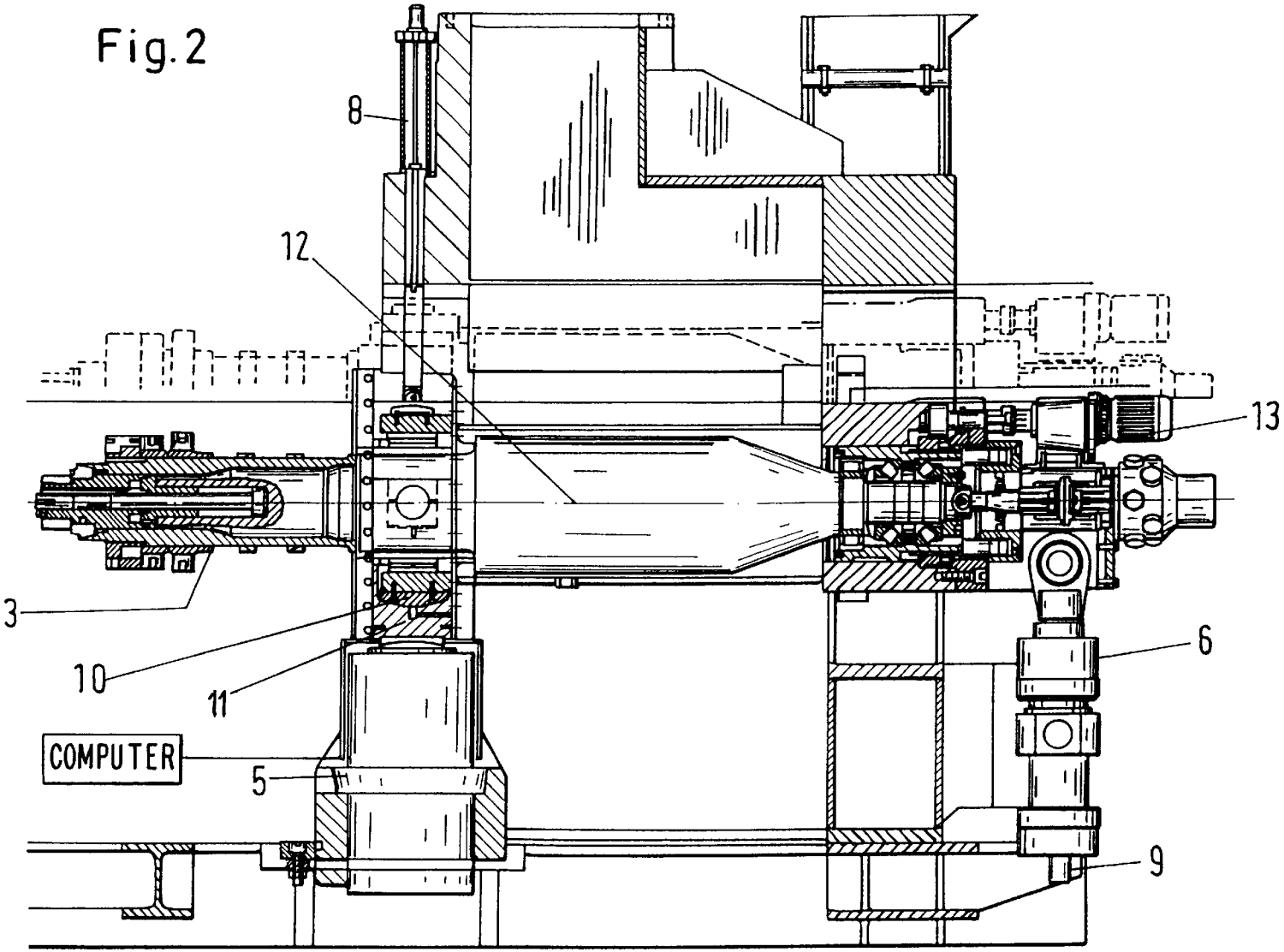
FIG. 2 shows just the lower straightening axle of the straightening roller unit, partially in section.

In the embodiment shown in FIG. 2, the displacement measurement device is not arranged on the basis of the vertical adjustment —that is to say underneath the straightening axle —but rather on the upright located opposite the straightening axle.

The displacement measurement device may be linear signal transmitter 8 with which a magnet, attached, as in the past, to the adjustable axle, is associated.

This refinement ensures that the roll spring of the installed elements and of the upright are also measured themselves with the result that only the bending up of the rollers has to be taken into account as an additional compensation value.

The invention is not limited by the embodiments described above which are presented as examples only but can be modified in various ways within the scope of protection defined by the appended patent claims.

We claim:

1. A method for straightening sections be eliminating multi-axle deviations from a required section and from required straightness, comprising the steps of: arranging a plurality of straightening tools in series above and below the material to be straightened on straightening axles which are parallel with one another; coupling vertically acting hydraulic cylinders to both ends of a straightening axle, the coupling step including arranging one of the hydraulic cylinders to face the straightening tools so as to act as a straightening force cylinder, and arranging another of the hydraulic cylinders to face away from the tools so as to act as an inclination cylinder; and adjusting vertical setting and horizontal inclination of the adjustable straightening axle hydraulically by a hydraulic system configured so that a rapid change in position is possible at both cylinders and exclusively at the inclination cylinder so that at least one of the straightening force and the horizontal inclination of the adjustable straightening axle can be set during straightening, inclination only being adjustable by the inclination cylinder for compensating for sagging of the straightening axle.

2. A method of defined in claim 1, including adjusting each straightening axle in the axial direction independently of the other straightening axle of the straightening process.

3. A method as defined in claim 1, wherein each adjustment device has a measuring system, the method further comprising feeding a signal from the measurement devices into a computer-based control model and calculating, taking into account geometry of the straightening machine and the measurement results, the position of the straightening roller and the setting of the straightening roller with the bending of the straightening axle which occurs, and determining straightening-gap-optimizing specifications, with which the straightening axles are set.

4. A machine for straightening sections by eliminating multi-axle deviations from a required section and from a required straightness, comprising a plurality of straightening tools arranged in series above and below the material to be straightened on straightening axles which are parallel with one another, and vertically acting hydraulic cylinders coupled to both ends of the straightening axle so as to permit adjustment of vertical setting and inclination of the adjustable straightening axle, one of the hydraulic cylinders being a straightening force cylinder arranged to face the straightening tools, and another of the hydraulic cylinders being an inclination cylinder arranged to face away from the tools, inclination of the adjustable straightening angle only being adjustable by the inclination cylinder in order to compensate for sagging of the straightening axle.

5. A machine as defined in claim 4, and further comprising means for hydraulically clamping and horizontally axially displacing the straightening axles mechanically independently of one another.

6. A machine as defined in claim 5, wherein the adjusting means includes horizontal adjustment drives embodied as threaded adjustment bushings which are clamped hydraulically free of play.

7. A machine as defined in claim 5, and further comprising a computer, displacement signal transmitters provided on the straightening force cylinder, on the inclination cylinder, and on the horizontal adjustment drive, and force measuring devices provided on the straightening force cylinder, measured values of the force being fed, together with measured values representing the measured current drain at the main drives, to the computer which is operative to calculate adjustment values for degrees of freedom of the machine based on a computational model.

8. A machine as defined in claim 7, wherein one of the displacement signal transmitters is attached to an upright located opposite the vertically adjustable straightening axle.

9. A machine as defined in claim 7, wherein the displacement signal transmitter is a linear signal transmitter having an associated magnet attached to the adjustable straightening axle.

* * * * *